US009498962B2

(12) United States Patent
Ishida et al.

(10) Patent No.: US 9,498,962 B2
(45) Date of Patent: Nov. 22, 2016

(54) PRINTING DEVICE

(71) Applicant: CANON KABUSHIKI KAISHA, Tokyo (JP)

(72) Inventors: Koichi Ishida, Tokyo (JP); Masahiko Kubota, Tokyo (JP); Nobuhito Yamaguchi, Inaga (JP); Hiroshi Arimizu, Kawasaki (JP); Yusuke Imahashi, Kawasaki (JP); Arihito Miyakoshi, Tokyo (JP); Yoshinori Itoh, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/808,355

(22) Filed: Jul. 24, 2015

(65) Prior Publication Data

US 2016/0031218 A1 Feb. 4, 2016

(30) Foreign Application Priority Data

Aug. 1, 2014 (JP) ..... 2014-157465

(51) Int. Cl.
*B41J 2/17* (2006.01)
*B41J 2/165* (2006.01)

(52) U.S. Cl.
CPC ..... *B41J 2/1714* (2013.01); *B41J 2/16585* (2013.01); *B41J 2/16538* (2013.01); *B41J 2202/21* (2013.01)

(58) Field of Classification Search
CPC ..... B41J 2002/16514; B41J 2002/1853; B41J 2002/1856; B41J 2/1714
USPC ..... 347/34
See application file for complete search history.

(56) References Cited

U.S. PATENT DOCUMENTS

2012/0007916 A1* 1/2012 Kumagai ..... B41J 2/16517 347/34
2015/0085014 A1* 3/2015 Ishida ..... B41J 2/1714 347/34
2015/0165770 A1 6/2015 Miyakoshi et al.

FOREIGN PATENT DOCUMENTS

JP 2005-271314 A 10/2005

OTHER PUBLICATIONS

Copending, unpublished U.S. Appl. No. 14/642,900 to Arimizu, et al., filed Mar. 10, 2015.

* cited by examiner

*Primary Examiner* — Jason Uhlenhake
(74) *Attorney, Agent, or Firm* — Fitzpatrick, Cella, Harper & Scinto

(57) ABSTRACT

A printing device includes: a head that ejects an ink on a medium to perform printing; and a mist collection mechanism having: a suction port facing the medium and sucking air near the head; an exhaust port discharging the sucked air; and an airflow path between the suction port and the exhaust port, wherein the airflow path includes a first spatial region located on a side of the suction port, and a second spatial region located on a side of the exhaust port and adjacent to the first spatial region through a communicating port having an opening area smaller than that of the suction port.

18 Claims, 12 Drawing Sheets

PRINTING DEVICE

BACKGROUND OF THE INVENTION

1. Field of the Invention

The present invention relates to a printing device that ejects an ink to perform printing on a medium, in particular, relates to a technique of supplying and discharging air around a print head (hereinafter, also simply referred to as a head).

2. Description of the Related Art

In general, inkjet printing devices have a problem in that minute inks (hereinafter, also referred to as ink mists or simply as mists), which are ejected from an ejection port of a nozzle provided on an ink ejecting surface of the head and do not reach the medium, are blown up by airflow occurring around the head, thereby contaminating the head or the vicinity thereof.

To deal with this, conventionally, there has been used an ink jet printing device configured to suck and collect the ink mists near the head. For example, Japanese Patent Laid-Open No. 2005-271314 discloses a mist collection mechanism, which has a duct extending upward from the vicinity of the ejection port of the nozzle, and sucks air containing the ink mists from an opening of the duct using an airflow-forming unit such as a fan, thereby collecting the ink mists.

SUMMARY OF THE INVENTION

However, in the configuration of the mist collection mechanism as disclosed in Japanese Patent Laid-Open No. 2005-271314, a region in which the inflow velocity of air is relatively small may be generated on a duct opening plane, depending on arrangement of the airflow-forming unit. This possibly leads to a situation where the air containing the ink mist is not sufficiently collected in such a region, and contaminates the head and its vicinity.

The present invention has been made in view of the circumstance described above. An object of the present invention is to provide an ink jet printing device, which can perform suction substantially at a uniform flow rate across the entire area of the duct opening plane regardless of arrangement of the airflow-forming unit, and reliably suppress contamination of the head and its vicinity by the ink mist.

In order to solve the problem described above, the present invention provides an ink jet printing device including:

a head that ejects an ink on a medium to perform printing; and a mist collection mechanism having:

a suction port facing the medium and sucking air near the head;

an exhaust port discharging the sucked air; and an airflow path between the suction port and the exhaust port, wherein the airflow path includes a first spatial region located on a side of the suction port, and a second spatial region located on a side of the exhaust port and adjacent to the first spatial region through a communicating port having an opening area smaller than that of the suction port.

According to the present invention, it is possible to achieve a uniform suction flow rate of air at the suction port of the mist collection mechanism, whereby it is possible to suppress leakage of the ink mist and contamination of the head and its vicinity.

Further features of the present invention will become apparent from the following description of exemplary embodiments (with reference to the attached drawings).

DESCRIPTION OF THE EMBODIMENTS

The present invention is applicable to a liquid ejecting device that ejects a liquid to apply various processes (for example, printing, processing, application, irradiation, reading, and inspection) to a medium. Hereinbelow, an embodiment of the present invention will be described using an ink jet printing device as an example of the liquid ejecting device as described above.

[Explanation of Terminology]

In the present specification, the "ink jet printing device" (hereinafter, also simply referred to as a printing device) is one type of the liquid ejecting device, and represents a device that ejects a liquid (ink) by an ink jet system to perform printing on a medium. For the inkjet system, it is possible to employ systems well known in this technical field, such as a system that employs a heat element, a system that employs a piezoelectric element, a system that employs an electrostatic element, and a system that employs a MEMS (Micro Electro Mechanical Systems) element.

In the present specification, the "printing" means forming meaningful information such as a letter and a graphic. In addition, the "printing" is not just limited thereto but broadly means forming, for example, an image, a design, or a pattern on the medium, or performing processing on the medium, regardless of whether it is meaningful or meaningless, or regardless of whether it is actualized so that humans can visually recognize it.

In the present specification, the "medium" broadly means a thing serving as a target to which an ink (liquid) is applied, irrespective of material and form, such as paper, cloth, a plastic film, a metal sheet, glass, ceramics, wood, leather, and a flexible board.

In the present specification, the "ink" should be broadly interpreted, as with the definition of the term "printing." More specifically, the "ink" represents a liquid applied on the medium, and can be used to form, for example, an image, a design and a pattern on the medium, perform processing on the medium, or perform a treatment of an ink (for example, coagulation or insolubilization of color material in another ink applied to the medium).

The first embodiment of the present invention will be described with reference to FIG. 1A to FIG. 6B.

(Printing Device)

Figure 1A:
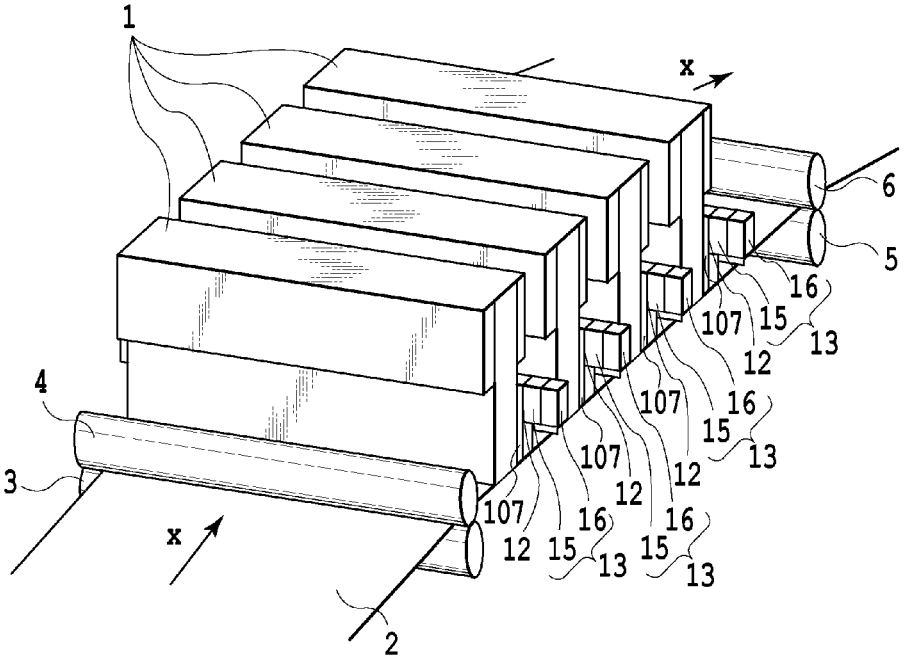
FIG. 1A and FIG. 1B are schematic views illustrating a configuration of an ink jet printing device according to a first embodiment.
Figure 1B:
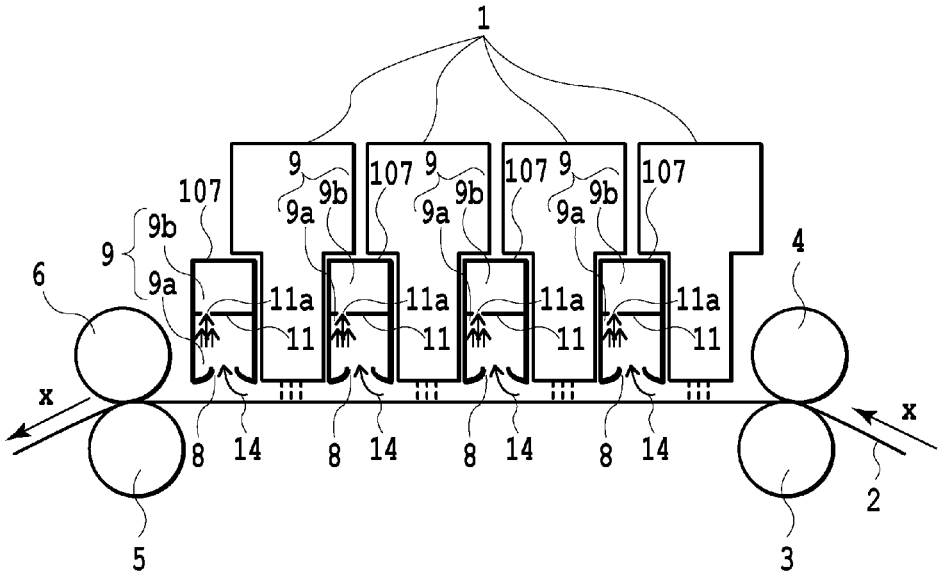

FIG. 1A is a perspective view schematically illustrating a configuration of the vicinity of a printing unit of an ink jet printing device according to the first embodiment of the present invention. FIG. 1B is a sectional view schematically illustrating the vicinity of the printing unit of the ink jet printing device illustrated in FIG. 1A and taken along a medium conveying direction X.

The ink jet printing device according to the first embodiment includes a conveying unit having a conveying mechanism that conveys a medium, a printing unit that performs printing on the medium conveyed by the conveying unit, and an ink-mist collection mechanism that collects an ink mist generated from the printing unit.

(Conveying Unit)

The conveying unit has: a pair of main conveying rollers including a conveying roller 3 and a pinch roller 4 that is driven to rotate by the conveying roller 3, and located on the upstream side of a head 1; and a pair of sub-conveying rollers including a conveying roller 5 and a pinch roller 6 that is driven to rotate by the conveying roller 5, and located on the downstream side of the head 1. A medium 2 is held between the pair of main conveying rollers as well as between the pair of secondary conveying rollers, and is conveyed within the printing unit in the medium conveying direction X with rotation of the conveying rollers 3 and 5.

(Printing Unit)

The printing unit includes plural heads 1 of a so-called full line system, in which ejection port lines are formed in a manner such that ejection ports of nozzles of an ink jet system are arranged in a range covering the maximum printing width (hereinafter, also simply referred to as a printing width) in a design of the printing device. The ejection port lines may be formed so that plural chips, each having a unit ejection port line formed therein, are regularly arranged across the printing width. For example, the ejection port lines may be arranged, for example, in a staggered arrangement. Alternately, ejection ports may be arranged into one line across the printing width. The printing unit ejects an ink from each of the ejection ports constituting the ejection port line, whereby printing can be performed on the medium conveyed to the printing unit.

The printing unit has four heads 1 in total: a black head for a black ink, a cyan head for a cyan ink, a magenta head for a magenta ink, and a yellow head for a yellow ink. However, in the present invention, the number of colors of ink and the number of heads are not limited to four. Each of these numbers may be less than four, or more than four.

Each of the heads 1 is connected with an ink tube, not illustrated, that supplies an ink from an ink tank, not illustrated. However, in the present invention, each of the heads 1 may be formed into one unit integrally with the ink tank that stores an ink of a corresponding color.

The plural heads 1 are each held by a head holder, not illustrated, so as to be integrated with a mist collection mechanism, which will be described later.

(Mist Collection Mechanism)

As illustrated in FIG. 1A and FIG. 1B, a mist collection mechanism 107 for removing air 14 containing an ink mist from a space around the head is provided on the downstream of each of the heads 1 in the medium conveying direction X. Each of the mist collection mechanisms 107 includes a suction port 8, a discharging port 12, and an airflow path 9 (air duct) connecting the suction port 8 with the discharging port 12 and extending between the both ports. The discharging port 12 is connected with a suction unit 13.

The suction port 8 is positioned so as to face the medium 2, and is opened across the entire maximum printing width in a design of the printing device. In this embodiment, each of the suction port 8 and the mist collection mechanism has a long side in the printing width direction of the printing device, that is, in the longitudinal direction of the head 1, and has a short side in the medium conveying direction.

The airflow path 9 includes a spatial region 9*a* extending upward from the suction port 8 and disposed on the upstream side of the flow path so as to face the medium 2, and a spatial region 9*b* disposed on the downstream side of the flow path and located adjacent to the spatial region 9*a* through a locally narrowed portion. The spatial region 9*a* and the spatial region 9*b* extend across the entire printing width, in other words, along the long side of the suction port 8. The airflow path 9 may be separated into the spatial region 9*a* and the spatial region 9*b* by a partition 11 positioned at the boundary between the suction port 8 and the discharging port 12. The partition 11 may be provided integrally with a side wall of the airflow path 9, or may be formed separately from a side wall of the airflow path 9 and adhere to the side wall.

A communicating port 11*a* serving as a locally narrowed portion and fluidically communicating the spatial region 9*a* and the spatial region 9*b* is formed at the boundary between the spatial region 9*a* and the spatial region 9*b*. The communicating port 11*a* may be a through-hole formed on the partition 11 itself, or may be provided as a space formed between an end portion of the partition 11 and the side wall of the airflow path 9, or between end portions of the partition 11.

Figure 2A:
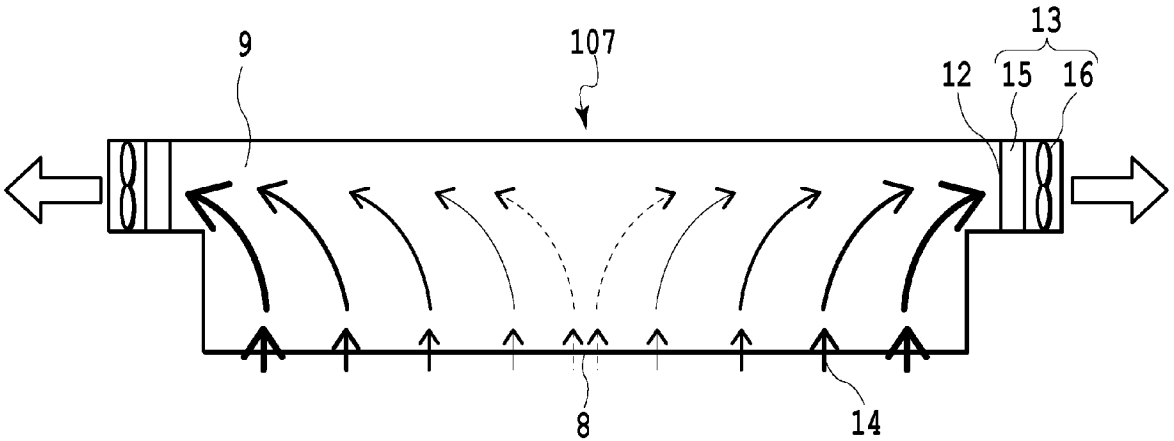
FIG. 2A is a sectional view schematically illustrating a mist collection mechanism according to a conventional technique.
Figure 2B:
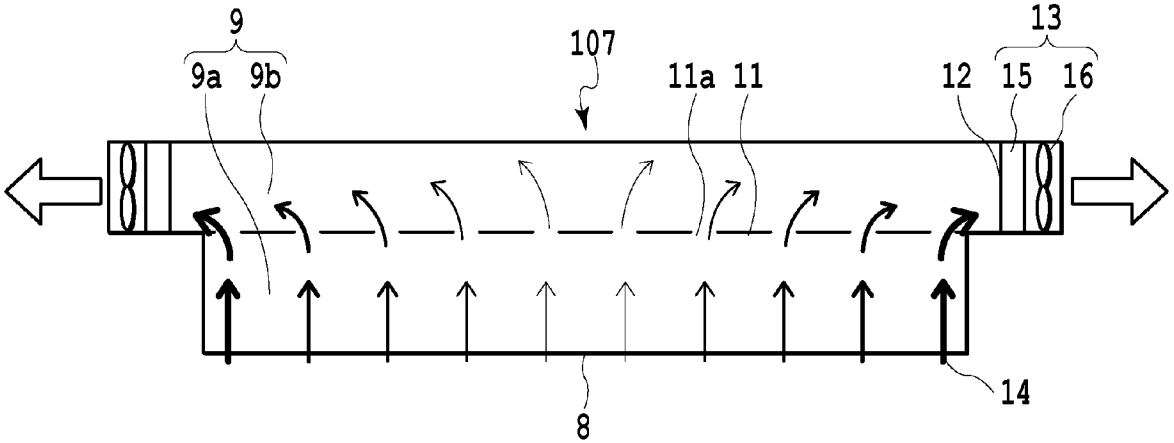
FIG. 2B is a sectional view schematically illustrating a mist collection mechanism according to the first embodiment of the present invention.

In this example, plural communicating ports 11*a* are arranged in a distributed manner across the printing width as illustrated in FIG. 2B. However, in the present invention, it is only necessary that the communicating ports 11*a* are arranged along the longitudinal direction of the suction port 8 of the mist collection mechanism 107, and the number of the communicating ports 11*a* is not limited. In other words, the present invention is not limited to a mode in which plural communicating ports 11*a* are distributed as in this example, and may have a mode in which a single communicating port extends. The area of opening of the single communicating port 11*a*, or the total area of openings of the plural communicating ports 11*a* is smaller than the area of opening of the suction port 8.

The discharging port 12 for discharging air from the spatial region 9*b* is provided on a side wall of the airflow path 9 extending upward from the suction port 8, at a position outer side of the printing width. A fan 16, which serves as the suction unit 13, is connected to the outside of the discharging port 12 through a filter 15. However, in the present invention, the suction unit 13 is not limited thereto, and a pump or the like may be connected in place of the fan. The filter 15 catches an ink mist contained in the air discharged from the spatial region 9*b* through the discharging port 12 to the outside.

With the configuration described above, once the suction unit 13 is activated, the air 14 around the head 1 is sucked from the suction port 8, flows into the spatial region 9*a*, flows into the spatial region 9*b* through the communicating port 11*a*, which is a locally narrowed portion, and then, is discharged through the discharging port 12 to the outside of the mist collection mechanism 107.

Effects of the mist collection mechanism according to the present invention will be described with reference to a schematic sectional view perpendicular to the medium conveying direction illustrated in FIG. 2A and FIG. 2B. FIG. 2A illustrates a mist collection mechanism according to a conventional technique. FIG. 2B illustrates the mist collection mechanism according to the first embodiment of the present invention. The same reference signs are attached to elements common in the drawings, and explanation thereof will not be repeated.

In both of the mist collection mechanisms illustrated in FIG. 2A and FIG. 2B, the air 14 around the head sucked by the suction unit 13 from the suction port 8 passes through the airflow path 9, and reaches the discharging port 12.

In the mist collection mechanism according to the conventional technique illustrated in FIG. 2A, the airflow path 9 is configured as one chamber having approximately the same flow path cross-sectional area over the entire length of the flow path. In the case where the suction unit 13 is activated with this configuration, the flow velocity of air sucked decreases as a distance from the exhaust port 12 is larger throughout the entire spatial region in the airflow path 9. Thus, depending on conditions, there is a possibility that air 14 containing an ink mist is not sufficiently sucked in a region farther away from the exhaust port 12 on the opening plane of the suction port 8, and stays in a space around the head or is leaked out. More specifically, since with the configuration illustrated in FIG. 2A, the exhaust port 12 is provided on both ends in the printing width direction, there is a possibility that such leakage of the ink mist tends to occur in a region in the vicinity of the center of the printing width where the distance from the exhaust port 12 is relatively large, on the opening plane of the suction port 8.

On the other hand, with the mist collection mechanism according to this embodiment illustrated in FIG. 2B, the airflow path 9 is divided in the longitudinal direction of the flow path into two chambers (the spatial region 9*a* and the spatial region 9*b*) that fluidically communicate with each other through the communicating port 11*a* which is the locally narrowed portion. In the case where the suction unit 13 is activated with this configuration, it is possible to cause the spatial region 9*b* to function as a pressure buffer chamber due to balance between the flow rate of air discharged from the spatial region 9*b* through the exhaust port 12 and the flow rate of air flowing into the spatial region 9*b* through the communicating port 11*a*. As described above, the communicating port 11*a* is disposed across the printing width. Thus, by causing the spatial region 9*b* to function as the pressure buffer chamber, flow of air is facilitated in the vicinity of the center of the printing width when air 14 flows from the spatial region 9*a* through the communicating port 11*a* into the spatial region 9*b*. In association with this, a slope of the flow rate of sucked air in the printing width direction is alleviated on the opening plane of the suction port 8.

Thus, according to this embodiment, it is possible to favorably collect air 14 containing an ink mist across the printing width, in other words, along the entire longitudinal direction of the suction port 8 of the mist collection mechanism 107. As a result, it is possible to favorably prevent contamination of the inside of the printing device and a printed matter.

It should be noted that, in the configurations illustrated in FIG. 2A and FIG. 2B, the exhaust port 12 is provided on both ends of the mist collection mechanism in the printing width direction in order to prevent an increase in height of the printing device due to a space occupied by the mist collection mechanism, and a reduction in drawing performance due to an increase in distance between plural heads 1. However, according to the present invention, it is possible to alleviate a slope of flow rate of air in the longitudinal direction of the suction port 8 by applying the present invention to various configurations such as a case where the exhaust port 12 is provided at the center in the printing width and the flow rate of air in the vicinity of both ends in the printing width is smaller than that in the vicinity of the center.

A preferred modification example of the mist collection mechanism according to the present invention will be described by the use of FIG. 3A to FIG. 6B.

((Size of Communicating Port and Arrangement of Communicating Ports in Printing Width Direction))

Figure 3A:
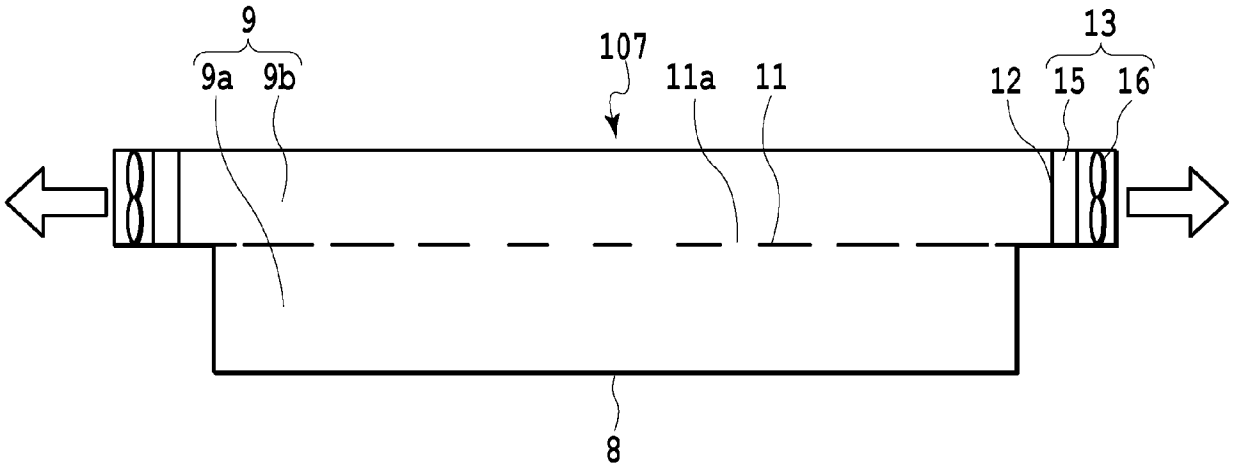
FIG. 3A and FIG. 3B are sectional views schematically illustrating a modification example of the mist collection mechanism according to the first embodiment.
Figure 3B:
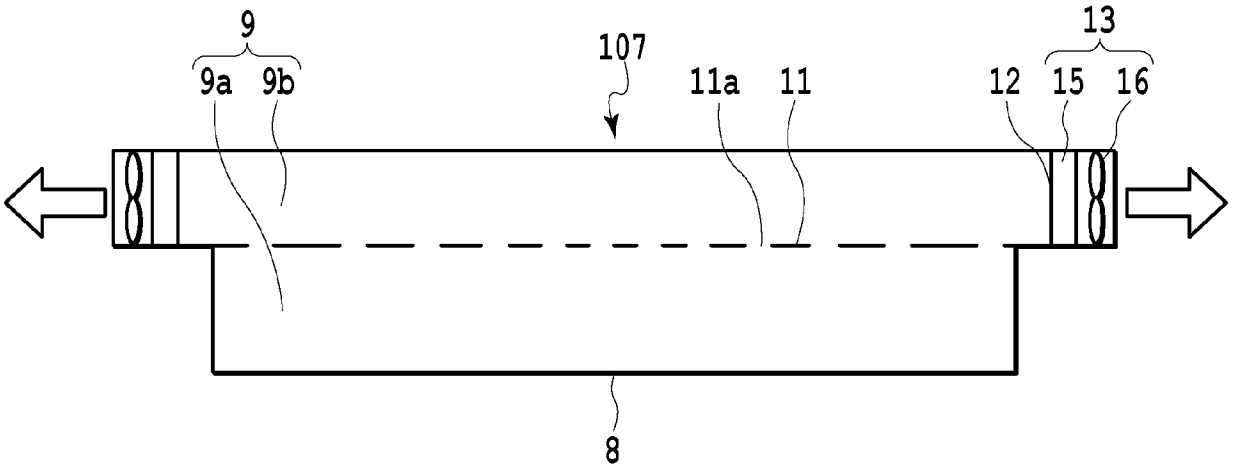

The modification example of the mist collection mechanism according to the present invention will be described in connection with the size of the communicating port 11*a* and arrangement of the communicating ports 11*a* in the printing width direction (in the longitudinal direction) with reference to FIG. 3A and FIG. 3B. FIG. 3A and FIG. 3B are schematic sectional views perpendicular to the medium conveying direction.

In the above-described mist collection mechanism illustrated in FIG. 2B, plural communicating ports 11*a* are arranged side by side in the printing width direction. In this example, the plural communicating ports 11*a* have the same opening area, and are arranged side by side at regular intervals. Furthermore, in the present specification, the interval between the communicating ports 11*a* represents a distance between the centers of the communicating ports 11*a*. In the case of this example, the flow rate of air 14 sucked through the communicating ports 11*a* into the spatial region 9*b* increases as a distance from the exhaust port 12 to the applicable communicating port 11*a* decreases, and decreases as the distance increases.

On the other hand, in the case of the modification example illustrated in FIG. 3A and FIG. 3B, the communicating ports 11*a* are configured such that a flow resistance increases as a distance from the exhaust port 12 decreases, and the flow resistance decreases as the distance from the exhaust port 12 increases, in order to achieve a more uniform flow rate of air 14 in the printing width (longitudinal) direction. In other words, at the boundary between the spatial region 9*a* and the spatial region 9*b*, the opening area of the communicating ports 11*a* contained per unit region is set so as to decrease as the distance from the exhaust port 12 decreases and increase as the distance from the exhaust port 12 increases.

More specifically, as illustrated, for example, in FIG. 3A, it is possible to arrange plural communicating ports 11*a* side by side at regular intervals, and set the opening area of each of the communicating ports 11*a* so as to decrease as the distance from the exhaust port 12 decreases and increase as the distance from the exhaust port 12 increases. Furthermore, as illustrated, for example, in FIG. 3B, it is possible to set the opening area of each of the communicating ports 11*a* so as to be equal to each other, and arrange the communicating ports 11 in a manner such that the number of the communicating ports 11*a* per unit region decreases as the distance from the exhaust port 12 decreases, and increases as the distance from the exhaust port 12 increases. Furthermore, it may be possible to combine the configurations illustrated in FIG. 3A and FIG. 3B. More specifically, it is possible to decrease the opening area of and the number of the communicating ports 11*a* per unit region as the distance from the exhaust port 12 decreases, and increase them as the distance increases.

In the present invention, the plural communicating ports 11*a* may or may not have the same shape or a similar shape. Furthermore, the number of the communicating ports 11*a* may be one or plural. In other words, the configuration in which one or more communicating ports 11*a* extend or are distributed in a manner such that the flow resistance decreases as the distance from the exhaust port 12 increases is included in the scope of the present invention.

((Shape of Suction Port and its Vicinity, and Arrangement of Communicating Ports in Medium Feeding Direction))

Figure 4C:
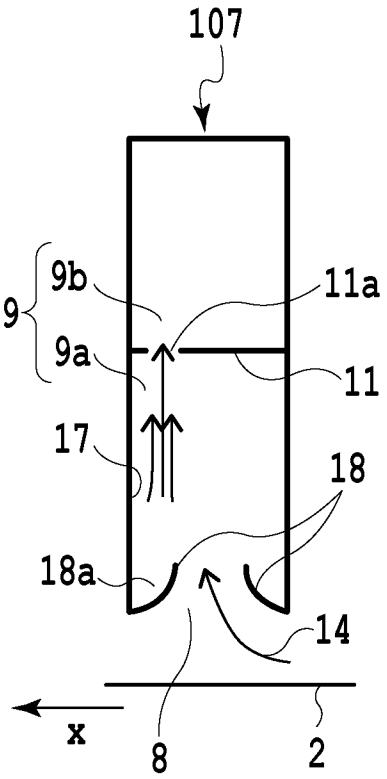
FIG. 4A to FIG. 4C are sectional views schematically illustrating another modification example of the mist collection mechanism according to the first embodiment.
Figure 4B:
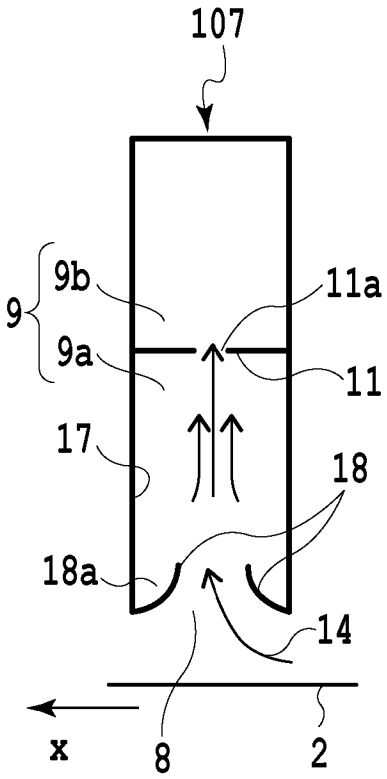
Figure 4A:
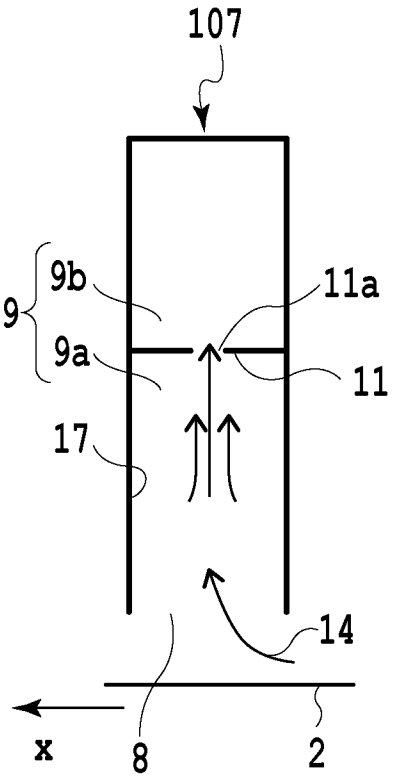

Next, with reference to FIG. 4A to FIG. 4C, a modification example of the mist collection mechanism according to the present invention will be described in connection with the shape of the suction port 8 and its vicinity and arrangement of the communicating ports 11*a* in the medium conveying direction X (in the short-side direction). FIG. 4A to FIG. 4C are schematic sectional views along the medium conveying direction X.

FIG. 4A illustrates one example of the mist collection mechanism according to the present invention. The spatial region 9*b* on the side of the exhaust port, which can function as the pressure buffer chamber, is provided within the airflow path 9 and adjacent to the spatial region 9*a* on the side of the suction port so as to face the medium 2, whereby it is possible to achieve a uniform flow rate of air sucked on the opening plane of the suction port 8.

FIG. 4B illustrates a preferred modification example of the configuration illustrated in FIG. 4A. Within the airflow path 9 of the mist collection mechanism, an ink mist may adhere to the inner wall 17 of the airflow path 9 due to, for example, disturbance of flow of air sucked or small static electricity. There is a possibility that the ink mist adhering to the inner wall 17 drops due to gravitation, and adheres to the medium 2, which leads to a deterioration in printing quality. To address this, the configuration illustrated in FIG. 4B includes a barb 18 for preventing droplets flowing downward in the gravity direction on the inner wall 17 of the airflow path 9, from dropping further downward than the opening plane of the suction port 8.

The barb 18 is configured to extend from at least a part of the peripheral edge of the suction port 8 on the side wall of the airflow path 9, or from the vicinity of the peripheral edge of the suction port 8 toward the inside of the airflow path 9. The barb 18 may extend horizontally, or the top end of or the whole of the barb 18 may extend upward in the gravity direction. Furthermore, the top end thereof may extend linearly, or may extend so as to draw a hook shape or curved line. The barb 18 may be formed integrally with the side wall of the airflow path 9, or may be formed as a separate portion and adhere to the peripheral edge of the suction port 8.

FIG. 4C illustrates a preferred modification example of the configuration illustrated in FIG. 4B. The communicating port 11*a* has an opening area formed so as to be smaller than the cross-sectional area of the flow path of the airflow path 9 so that a suction flow rate is made uniform across the printing width direction (the longitudinal direction). Thus, the flow velocity of air 14 containing an ink mist is faster in the vicinity of the communicating port 11*a*, and the flow is more likely to be disturbed, which leads to a situation where an ink mist is more likely to adhere in the vicinity of the communicating port 11*a* as compared with other locations.

To address this, in the mist collection mechanism illustrated in FIG. 4C, the communicating port 11*a* is positioned vertically above the barb 18 so that the barb 18 can receive an ink mist, which adheres in the vicinity of the communicating port 11*a* and drops due to gravitation. In other words, the communicating port 11*a* is positioned at a corresponding position within a range of a liquid receiver 18*a* of the barb 18 in the horizontal direction. The communicating port 11*a* may not be disposed at the central portion of the mist collection mechanism in the medium conveying direction X, and it may be possible to dispose the communicating port 11*a* so as to be close to one of the side walls.

In FIG. 4C, the barb 18 is provided on both of the upstream side and the downstream side in the medium conveying direction X. However, it may be possible to employ a configuration in which the barb 18 is provided only on one side at a position immediately below the communicating port 11*a*.

((Arrangement of Communicating Ports in Vertical Direction))

Figure 5C:
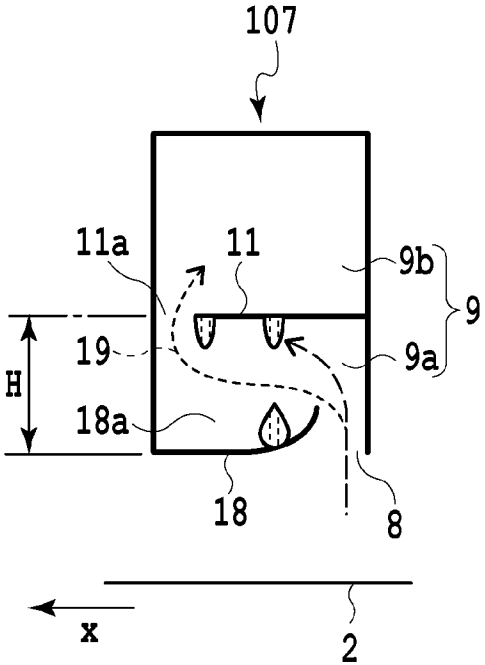
FIG. 5A to FIG. 5C are sectional views schematically illustrating another modification example of the mist collection mechanism according to the first embodiment.
Figure 5B:
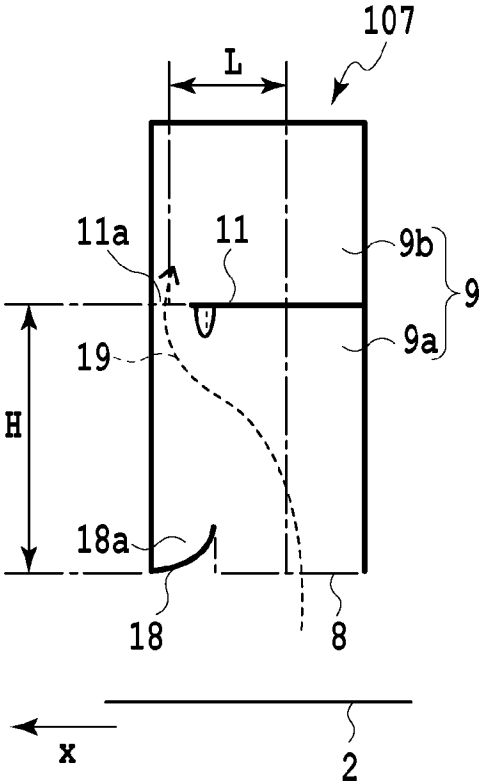
Figure 5A:
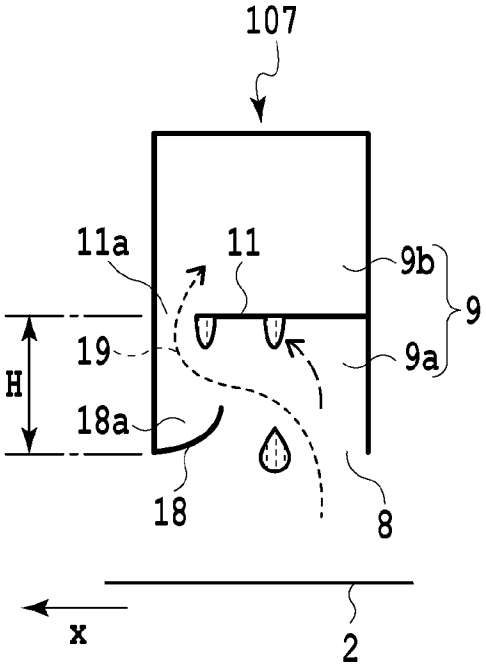

Next, with reference to FIG. 5A to FIG. 5C, a modification example of the mist collection mechanism of the present invention will be described in connection with arrangement of the communicating ports 11*a* in the airflow path 9 in the vertical direction. FIG. 5A to FIG. 5C are schematic sectional views along the medium conveying direction X.

FIG. 5A illustrates an example in which the height H from the opening plane of the suction port 8 to the opening plane of the communicating port 11*a* is set to be low, and thus the mist collection mechanism 107 is configured to be compact. In the case of the reduced height H, it is possible to suppress an increase in the size of the entire printing device, which mounts the mist collection mechanism 107.

FIG. 5B and FIG. 5C illustrate preferred modification examples of the configuration illustrated in FIG. 5A. In the case of a reduced height H, as the flow velocity U of airflow 19 flowing in from the upstream side increases, there is a possibility that an ink mist having a large particle diameter cannot curve along the streamline due to its heavy weight, and deviates from the airflow 19, thereby colliding against the bottom surface of the partition 11. The ink mist colliding against the bottom surface of the partition 11 drops due to gravitation, and adheres to the medium 2, possibly deteriorating printing quality.

To address this, in the mist collection mechanism illustrated in FIG. 5B, the height H from the opening plane of the suction port 8 to the opening plane of the communicating port 11*a* is set to be high to a certain degree. By setting the position of the communicating port 11*a* to a higher position so as to increase the radius of curvature of the streamline that the airflow 19 draws, it is possible to suppress collision of an ink mist against the bottom surface of the partition 11.

The height H set for suppressing collision can be expressed, for example, as following Formula (I), where L is an amount of offset between the suction port 8 and the communicating port 11*a* in the horizontal direction, p is a density of an ink, U is a flow velocity of the airflow 19, D is the maximum mist diameter, and IA is a dynamic viscosity of gas. Note that, in the present specification, the amount L of offset represents a horizontal distance between the center of the suction port 8 and the center of the communicating port 11*a*.

$$(L^2+H^2)/2L>\rho*U*D^2/9\mu \quad \text{Formula (I)}$$

For example, Formula (I) results in H>4 mm, where U=1 m/s, L=4 mm, D=25 μm, the ink is water, and the gas is air. If the height H is set so as to satisfy Formula (I), the Stokes number, which serves as an indicator of followability of a particle with respect to airflow, is 0.5 or less, and the trail of an ink mist substantially matches the streamline of the airflow 19. Thus, it is possible to suppress adhesion of the ink mist to the bottom surface of the partition 11.

As described above, it is possible to determine a preferred height H in consideration of various conditions, suppression of an increase in the size of the printing device, and a reduction in a possibility of contamination due to adhesion of an ink mist. Note that Formula (I) and the threshold value of the Stokes number described above are merely examples in connection with the embodiment of the present invention, and do not limit the present invention.

Furthermore, in the case of the mist collection mechanism illustrated in FIG. 5C, while the height H is set to be low to ensure compactness thereof as with the example illustrated in FIG. 5A, the barb 18 provided in the vicinity of the suction port 8 and vertically below the communicating port 11*a* is made largely protrude toward the inside of the liquid flow path 9. With this configuration, an ink mist departed from the airflow 19 adheres to the bottom surface of the partition in the vicinity of the communicating port 11*a* in a concentrated manner, whereby the bottom surface of the partition 11 in the vicinity of the communicating port 11*a* is caused to function as a mist adhering unit. The ink mist having collided against the bottom surface of the partition 11 drops due to gravitation, and is received by the liquid receiver 18*a* of the barb 18 provided vertically below the partition 11. With this configuration, it is possible to suppress adhesion of the dropped ink mist to the medium 2.

((Shape of Airflow Path))

Figure 6A:
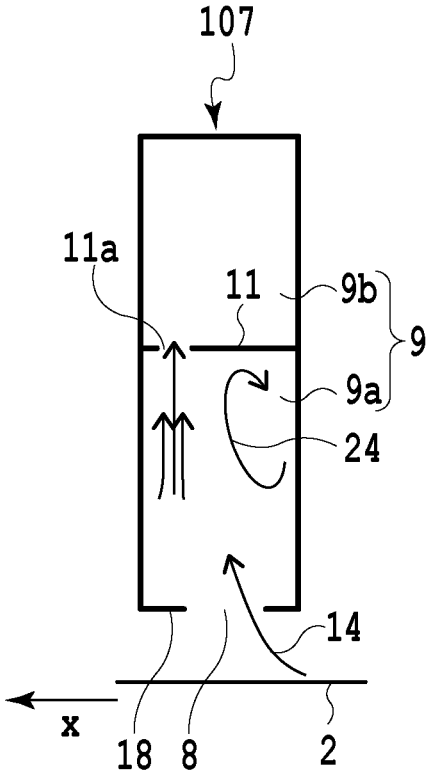
FIG. 6A and FIG. 6B are sectional views schematically illustrating another modification example of the mist collection mechanism according to the first embodiment.
Figure 6B:
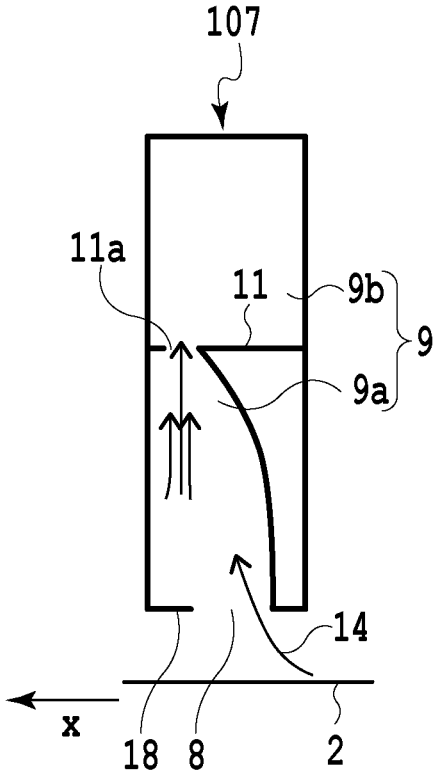

Next, with reference to FIG. 6A and FIG. 6B, a modification example of an ink collection mechanism according to the present invention will be described in connection with the shape of the airflow path 9. FIG. 6A and FIG. 6B are schematic sectional views along the medium conveying direction X.

FIG. 6A illustrates one example of the mist collection mechanism according to the present invention. The spatial region 9*b*, which can function as the pressure buffer chamber, is provided within the airflow path 9, whereby it is possible to achieve a uniform flow rate of air on the opening plane of the suction port 8.

In the present invention, the flow velocity of air sucked by the suction unit 13 can be varied for each of conditions such as printing duty (amount of ink applied per unit region on the medium), a type of a medium, a width size of the medium, a type of an ink, and the conveying speed of the medium. In the example of the configuration illustrated in FIG. 6A, the spatial region 9*a* on the side of the suction port 8 of the airflow path 9 has a cuboid shape. Thus, depending on the flow velocity of air sucked by the suction unit 13, there is a possibility that a vortex 24 of air is more like to occur at a corner of the spatial region 9*a*, and an ink mist adheres in the vicinity of the bottom surface of the partition 11 serving as a ceiling of the spatial region 9*a*, and drops on the medium 2.

On the other hand, FIG. 6B illustrates a preferred modification example of the mist collection mechanism illustrated in FIG. 6A. As illustrated in FIG. 6B, the airflow path 9 is formed in a manner such that the cross-sectional area of a flow path in the spatial region 9*a* gradually reduces from the suction port 8 to the communicating port 11*a*. Preferably, the flow path in the spatial region 9*a* is formed into a streamline shape.

With this configuration, it is possible to suppress occurrence of the vortex 24 of air in the spatial region 9*a* of the airflow path 9, whereby it is possible to suppress adhesion of a mist in the vicinity of the bottom surface of the partition 11 and dropping of the mist on the medium 2.

The modification examples of the mist collection mechanism 107 according to the first embodiment of the present invention have been described from various viewpoints. The configurations of these modification examples can be combined, and be used.

A second embodiment of the present invention will be described with reference to FIG. 7A to FIG. 7C. In the drawings, the same reference signs are attached to portions having configurations similar to those of the first embodiment, and explanation thereof will not be repeated.

(Mist Collection Mechanism)

Figure 7C:
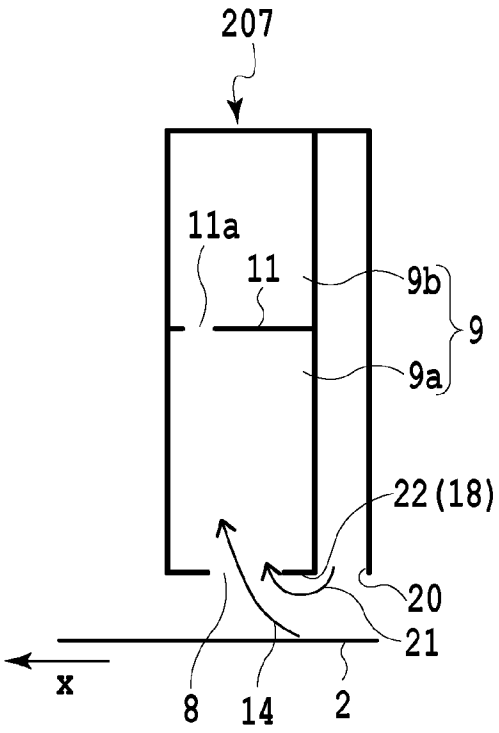
FIG. 7A to FIG. 7C are sectional views schematically illustrating a mist collection mechanism according to a second embodiment.
Figure 7B:
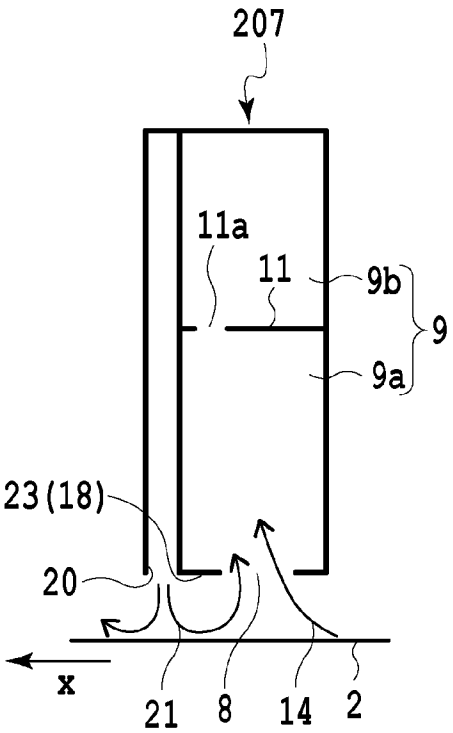
Figure 7A:
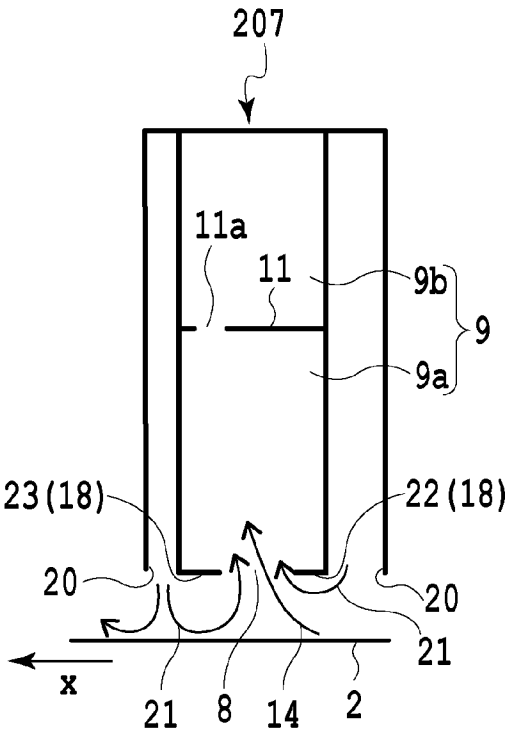

FIG. 7A to FIG. 7C each illustrate a configuration example of a mist collection mechanism according to the second embodiment of the present invention. FIG. 7A to FIG. 7C are schematic sectional views along the medium conveying direction X.

A mist collection mechanism 207 according to the second embodiment includes the spatial region 9*b* that is disposed in the airflow path 9 and can function as the pressure buffer chamber, whereby it is possible to achieve a uniform flow rate of air on the opening plane of the suction port 8, as described in the first embodiment.

The mist collection mechanism 207 illustrated in FIG. 7A further includes a blowout port 20 that is disposed on both of the upstream side and the downstream side of the suction port 8 in the medium conveying direction X and blows out air 21 toward the medium 2, and a blowout unit, not illustrated.

The air 21 blows out from the blowout ports 20 on the upstream side and the downstream side of the suction port 8 in the medium conveying direction X, whereby it is possible to facilitate flow-in of air 14 containing an ink mist in the vicinity of the surface of the medium 2, to the suction port 8.

At this time, the air 21 blowing out from the upstream side of the suction port 8 is sucked into the suction port 8 along a wall 22 (bottom surface of the barb 18) on the upstream side that demarcates the suction port 8. Similarly, the air 21 blowing out from the downstream side of the suction port 8 is sucked into the suction port 8 along a wall 23 (bottom surface of the barb 18) on the downstream side that demarcates the suction port 8. Thus, the air 14 containing an ink mist is moved away from the wall 22 on the upstream side and the wall 23 (bottom surface of the barb 18) on the down stream side, each of which demarcates the suction port 8, due to the air 21 blown out from the blowout port 20 and flowing into the suction port 8, and it is possible to suppress adhesion of an ink mist in the vicinity of the suction port 8.

Furthermore, by adjusting a volume of air 21 blowing out from the downstream side of the suction port 8 to be relatively larger, it is possible to further prevent the air 14 containing an ink mist in the vicinity of the surface of the medium 2, from flowing out toward the downstream side of the suction port 8. Thereby, the air 14 in the vicinity of the surface of the medium 2 can be easily sucked from the suction port 8, and the flow rate of air to be sucked by the suction unit 13 can be reduced, and thus it is possible to efficiently collect the ink mist.

In addition, it may also be possible to employ a configuration in which the blowout port 20 is provided on either the downstream side or the upstream side of the suction port 8 in the medium conveying direction X, as illustrated in FIG. 7B and FIG. 7C. For example, in the case where an ink mist significantly adheres to the wall 23 (barb 18) on the downstream side, it may also be possible to provide the blowout port 20 only on the downstream side as illustrated in FIG. 7B. Similarly, for example, in the case where an ink mist significantly adheres to the wall 22 (barb 18) on the upstream side, it may also be possible to provide the blowout port 20 only on the upstream side as illustrated in FIG. 7C. In these cases, since the blowout port 20 is not provided on either the upstream side or the downstream side, it is possible to configure the mist collection mechanism 207 in a more compacted manner while securing a required effect obtained from blowing out.

It may also be possible to vary the flow rate of air blowing out from the blowout port 20, a ratio of flow rates of air blowing out from the upstream and the downstream, and the like depending on conditions such as printing duty (amount of ink applied per unit region on the medium), a type (material) of a medium, a width size of the medium, a type (color and component) of an ink, the conveying speed of the medium.

The printing device may further include a control device configured to control temperatures and humidity of air blown out from a blowout unit. In the case where temperatures and humidity of the air blown out from the blowout unit are controlled, it is possible to control the temperatures and humidity of a space between the head 1 and the medium 2, whereby it is possible to optimize conditions of ejection of ink from the head.

A third embodiment of the present invention will be described with reference to FIG. 8A and FIG. 8B. In the drawings, the same reference signs are attached to portions configured similar to those of the first and second embodiments, and explanation thereof will not be repeated.

(Printing Device)

An ink jet printing device according to the third embodiment includes a conveying unit (not illustrated), a printing unit, and an ink-mist collection mechanism. FIG. 8A is a perspective view schematically illustrating a configuration of the vicinity of the printing unit of the ink jet printing device according to the third embodiment. In FIG. 8A, a mist collection mechanism 307 is illustrated so as to be cut along the short-side direction thereof in the vicinity of the center in the printing width for the purpose of explaining the internal structure. FIG. 8B is a schematic view illustrating a cross-sectional plane illustrated in FIG. 8A.

(Conveying Unit)

The conveying unit, not illustrated, is configured in a manner similar to that in the first embodiment, and hence, explanation thereof will not be repeated. As illustrated in FIG. 8A, the conveying unit conveys the medium 2 in the medium conveying direction X below a head 301 at the time of printing.

(Printing Unit)

In the first and second embodiments, the printing unit includes plural heads 1 corresponding to respective plural ink colors. However, in the third embodiment, the printing unit includes a head 301, which is a so-called multi-color head that ejects plural colors of ink from one head to perform printing. The head 301 is a full line system, and has plural ejection port lines in which ejection ports of nozzles of an ink jet system are arranged side by side in a range covering the maximum printing width (the width indicated by the arrow 2*b* in FIG. 8A) in a design of the printing device. In this example, each of the ejection port lines ejects a black ink, a cyan ink, and a magenta ink. The head 301 is held integrally with a head holder, not illustrated, so as not to move relatively with respect to the mist collection mechanism 307. The printing unit performs printing on the medium 2 positioned below the head 301. In FIG. 8A, the region 2*a* indicates a region on which printing has been performed.

(Mist Collection Mechanism)

Figure 8A:
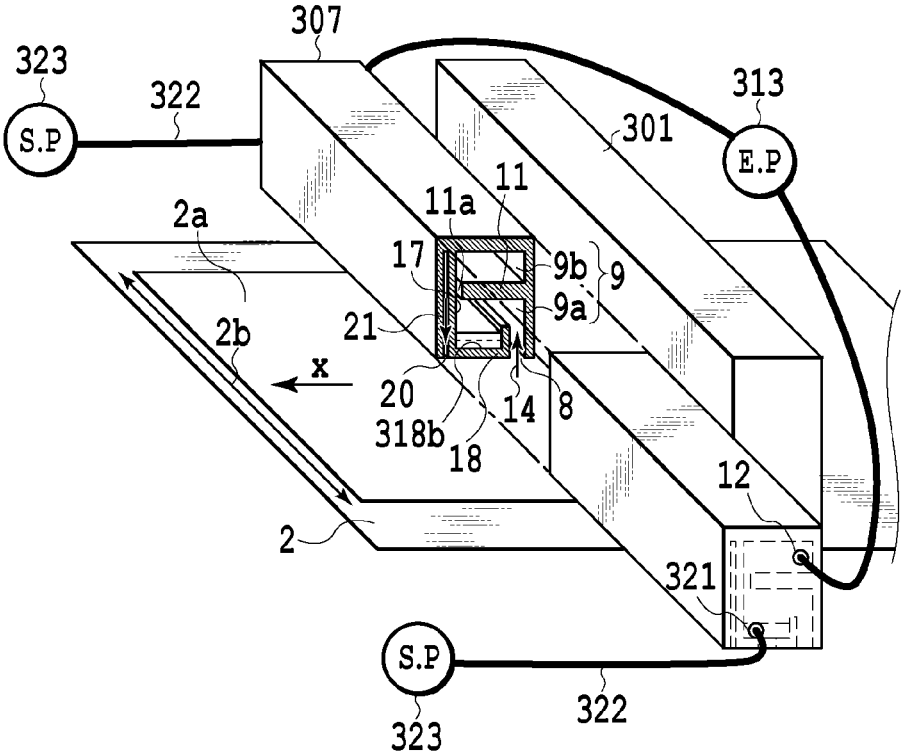
FIG. 8A and FIG. 8B are schematic views illustrating a configuration of an ink jet printing device according to a third embodiment.
Figure 8B:
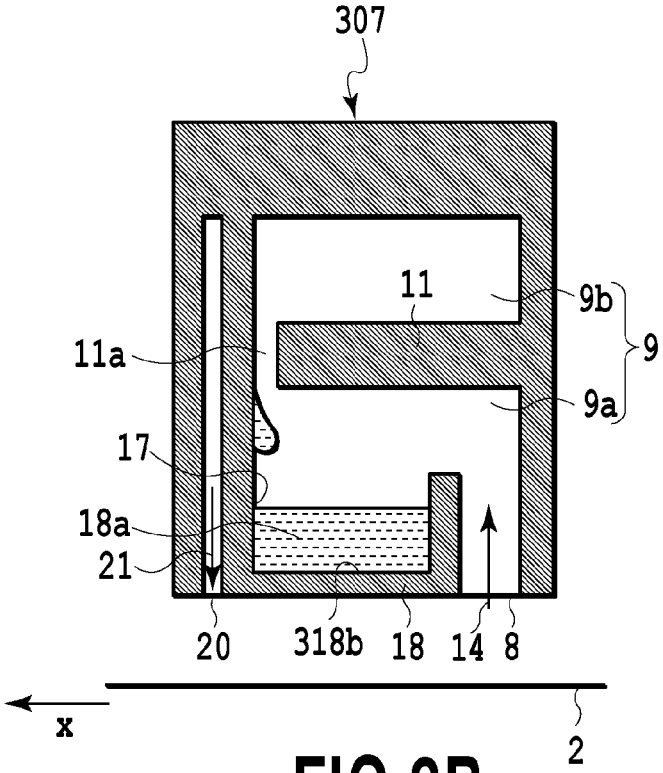

As described in the first embodiment, the mist collection mechanism 307 according to the third embodiment includes, in the airflow path 9, the spatial region 9*b* that can function as the pressure buffer chamber as illustrated in FIG. 8A and FIG. 8B. With this configuration, it is possible to achieve a uniform flow rate of air on the opening plane of the suction port 8. Note that, in this embodiment, a pump is used as the suction unit 313 to suck air 14 from the suction port 8. In this embodiment, each of the suction port 8 and the mist collection mechanism 307 has the long side in the printing width direction of the printing device, that is, in the longitudinal direction of the head 301, and has the short side in the medium conveying direction.

The blowout port 20 which blows out air 21 toward the medium 2, and the blowout unit, not illustrated, are provided on the downstream side of the suction port 8 in the medium conveying direction X, as in the second embodiment. With this configuration, the air 21 blown out from the blowout port 20 and flowing into the suction port 8 makes it possible to facilitate air 14 flowing into the vicinity of the surface of the medium 2, and suppress adhesion of an ink mist to the vicinity of the suction port 8 of the mist collection mechanism. Furthermore, it is possible to prevent the air 14 in the vicinity of the surface of the medium 2 from flowing out toward the downstream side of the suction port 8. This reduces the flow rate of air to be sucked by the suction unit 313, which makes it possible to efficiently collect the ink mist.

The barb 18 largely protruding toward the inside of the liquid flow path 9 is provided in the vicinity of the suction port 8 vertically below the communicating port 11*a*. The ink mist sucked from the suction port 8 collides against the bottom surface of the partition 11 and adheres to it. This ink mist drops due to gravitation, and is received by the liquid receiver 18*a* of the barb 18 provided below the partition 11 in the vertical direction. The waste liquid of ink mist received by the liquid receiver 18*a* of the barb 18 is discharged to the outside from a discharging port 321 provided on both ends of the mist collection mechanism 307 in the longitudinal direction.

An internal bottom surface 318*b* of the liquid receiver 18*a* of the barb 18 is gradually tilted from the central portion toward both end portions in the longitudinal direction of the mist collection mechanism 307 so that the central portion is set higher and both end portions are set lower, in other words, the height in the vertical direction gradually decreases toward both end portions. With this configuration, the waste liquid of ink mist received by the liquid receiver 18*a* is guided due to gravitation to the discharging port 321 provided on both ends of the mist collection mechanism in the longitudinal direction.

The discharging port 321 is connected with a sucking device 323 through a tube 322. For example, the sucking device 323 may be a pump including a gas-liquid separation mechanism. By activating the sucking device 323, the waste liquid of ink mist stored in the liquid receiver 18*a* is sucked through the tube 322, and is discharged to the outside. Note that, in the present invention, the liquid discharging mechanism for discharging waste liquid is not limited to a mechanism that utilizes a suction force by a pump, and it is possible to use any known mechanism that guides a liquid with physical force. For example, the liquid discharging mechanism may be a mechanism that is connected with a porous member and utilizes osmotic pressure, a mechanism that utilizes gravitational force by using a flow-down guide having a devised groove shape, or a combination of various mechanisms.

A fourth embodiment of the present invention will be described with reference to FIG. 9A, FIG. 9B, FIG. 10A, and FIG. 10B. In the drawings, the same reference signs are attached to portions having configurations similar to those of the first to third embodiments, and explanation thereof will not be repeated.

The fourth embodiment differs from the third embodiment in a configuration for discharging a waste liquid in the mist collection mechanism. In recent years, in order to further increase the printing speed of the printing device, the maximum printing width in a design is increased, and along with this, the length of the mist collection mechanism in the longitudinal direction is increased, or physical properties of ink used are modified (for example, an increase in viscosity). With an increase in the length of the mist collection mechanism, an increase in the viscosity of ink, or the like, there may be a case where constraint is generated in guiding the waste liquid of ink mist to the discharging port 321 provided on both ends of the mist collection mechanism in the longitudinal direction. The fourth embodiment is an effective configuration for favorably discharging the waste liquid of ink mist collected in the mist collection mechanism to the outside.

(Printing Device)

Figure 9A:
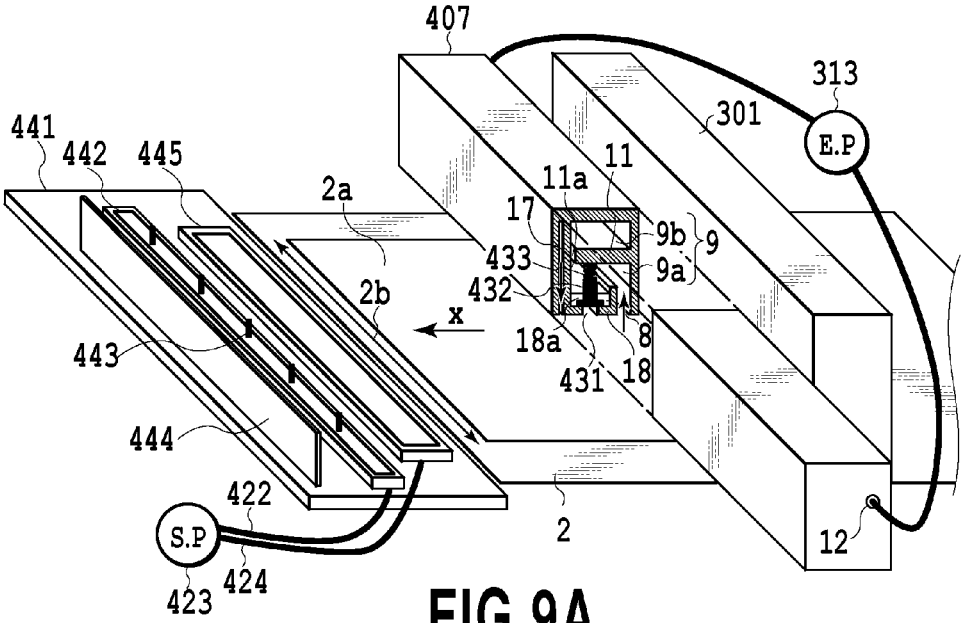
FIG. 9A and FIG. 9B are schematic views illustrating a configuration of an ink jet printing device according to a fourth embodiment.
Figure 9B:
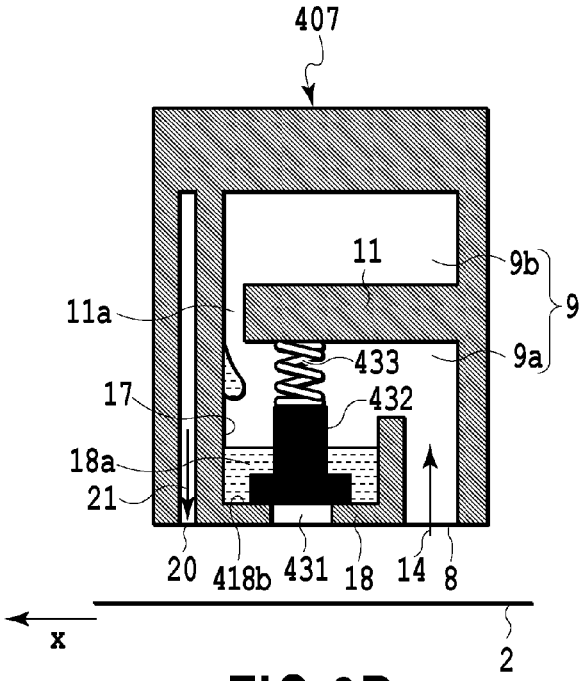

An ink jet printing device according to the fourth embodiment includes a conveying unit (not illustrated), a printing unit, an ink-mist collection mechanism, and a cleaning mechanism. FIG. 9A is a perspective view schematically illustrating a configuration of the vicinity of the printing unit of the ink jet printing device according to the fourth embodiment. In FIG. 9A, a mist collection mechanism 407 is illustrated so as to be cut along the short-side direction thereof in the vicinity of the center in the printing width for the purpose of explaining the internal structure. FIG. 9B is a schematic view illustrating a cutting plane illustrated in FIG. 9A.

(Conveying Unit, Printing Unit)

The conveying unit, not illustrated, and the printing unit each have a similar configuration to those in the third embodiment, and hence, explanation thereof will not be repeated. However, in this example, in order to achieve a durable printed matter, an ink containing a resin material is used.

(Mist Collection Mechanism)

The mist collection mechanism 407 according to the fourth embodiment includes, in the airflow path 9, the spatial region 9*b* that can function as the pressure buffer chamber as described in the first embodiment, which makes it possible to achieve a uniform flow rate of air on the opening plane of the suction port 8. In this embodiment, each of the suction port 8 and the mist collection mechanism 407 has the long side in the printing width direction of the printing device, that is, in the longitudinal direction of the head 301, and has the short side in the medium conveying direction.

In the third embodiment, the discharging port 321 is provided on both ends of the mist collection mechanism 307 in the longitudinal direction, and the waste liquid of ink mist stored in the liquid receiver 18*a* is discharged to the outside from the discharging port 321. On the other hand, in this example, since the ink containing a resin material is used as described above, there is a constrain on fluidity of the waste liquid of ink mist stored in the liquid receiver 18*a*. In the fourth embodiment, in order to ensure a waste-liquid collection property even in such a case, a discharging port 431 for discharging a waste liquid of ink mist is provided on a bottom surface 418*b* of the liquid receiver 18*a* of the barb 18 of the mist collection mechanism 407.

There are plural discharging ports 431 provided along the longitudinal direction of the mist collection mechanism 407. Part of the plural discharging ports 431 are disposed above a printing region in an area of the printing width (the width indicated by the arrow 2*b* in the drawing). Note that it may be possible that all of the plural discharging ports 431 are disposed above the printing region in the range of the printing width.

A discharging valve 432 is provided corresponding to each of the discharging ports 431. At the time of performing normal printing, the discharge valve 432 is brought into contact with the peripheral edge of the discharging port 431 with energizing force of an energizing unit 433 such as a spring, whereby the discharging port 431 is closed.

The mist collection mechanism 407 can be cleaned with a cleaning mechanism described later. A control device, not illustrated, determines that a predetermined maintenance period has arrived, and causes the cleaning mechanism to execute a cleaning operation. More specifically, the control device, when determining that the predetermined maintenance period has arrived, causes the discharging port 431 to open, and discharge the waste liquid of ink mist stored in the liquid receiver 18*a*. The cleaning operation may be performed for each predetermined maintenance period. However, the predetermined maintenance period is not limited to this. For example, it is possible to set a periodic time interval so that the waste liquid of ink mist stored in the liquid receiver 18*a* does not overflow from the liquid receiver 18*a*.

(Cleaning Mechanism)

A cleaning mechanism 441 according to the fourth embodiment will be described in detail with reference to FIG. 9A.

The ink jet printing device according to the fourth embodiment includes, around the head 301, the cleaning mechanism 441 that is brought into contact with the mist collection mechanism 407 and is configured to suck and discharge the waste liquid of ink mist stored in the mist collection mechanism 407. In this example, the cleaning mechanism 441 is disposed above the medium 2 and on the downstream side of the head 301 and the mist collection mechanism 407 in the medium conveying direction X.

The cleaning mechanism 441 includes a rubber pad 442 that is brought into close contact with the mist collection mechanism 407 to enable suction by the sucking device 423. The pad 442 has a valve opening mechanism on a surface on a side brought into contact with the mist collection mechanism 407. The valve opening mechanism includes a valve opening pin 443 for pushing up and opening the discharging valve 432 that has closed the discharging port 431. The valve opening pin 443 is provided at a position corresponding to each of the discharging valves 432, and can pass through the inside of the corresponding discharging port 431. The pad 442 is connected with the sucking device 423 through the discharging tube 422. When the upper surface of the pad 442 is brought into contact with the lower surface of the mist collection mechanism 407, the sucking device 423 depressurizes a space sandwiched by these surfaces, thereby sucking the waste liquid of ink mist stored in the mist collection mechanism 407 to discharge it to the outside.

It should be noted that the upper surface of the pad 442 is brought into contact with or spaced apart from the lower surface of the mist collection mechanism 407 by a slide mechanism 451 and a vertical mechanism 452, each of which will be described later with reference to FIG. 10A and FIG. 10B.

Furthermore, the cleaning mechanism 441 may include a wiper blade 444 serving as a wipe mechanism that wipes the waste liquid remaining on the bottom surface of the mist collection mechanism 407 (in particular, the bottom surface of the barb 18) in the vicinity of the discharging port 431 after the cleaning mechanism 441 sucks the waste liquid from the discharging port 431 and discharges it. The wiping with the wipe mechanism makes it possible to prevent the waste liquid of ink mist remaining on the bottom surface of the mist collection mechanism 407 in the vicinity of the discharging port 431, from contacting with or dropping on the medium 2 to contaminate the medium 2 when the next printing is performed.

In addition, the cleaning mechanism 441 may include a recovery pad 445 that serves as a recovery mechanism configured to recover an ink ejecting performance of the head 301 and is used for suction of the head 301. The recovery pad 445 is connected with a suction mechanism through a discharging tube 424. At this time, the sucking device 423 for cleaning the mist collection mechanism 407 may be used also as a suction mechanism for recovering the head 301. Note that the recovery pad 445 may be connected with a sucking device different from the sucking device for the pad 442 described above.

In this embodiment, the cleaning mechanism 441 may include the recovery pad 445 for recovering performance of the head 301 together with the pad 442 for cleaning the mist collection mechanism 407. Furthermore, the pad 442 and the recovery pad 445 may be connected with the same sucking device 423. Thus, by relatively moving the cleaning mechanism 441 and the head 301 using both of the slide mechanism 451 and the vertical mechanism 452, it is possible to recover suction of the head 301 when cleaning the mist collection mechanism 407.

(Cleaning Operation)

A cleaning operation in the mist collection mechanism according to the fourth embodiment will be described with reference to FIG. 10A and FIG. 10B. The cleaning operation includes an operation of discharging a waste liquid and an operation of wiping a surface.

Figure 10A:
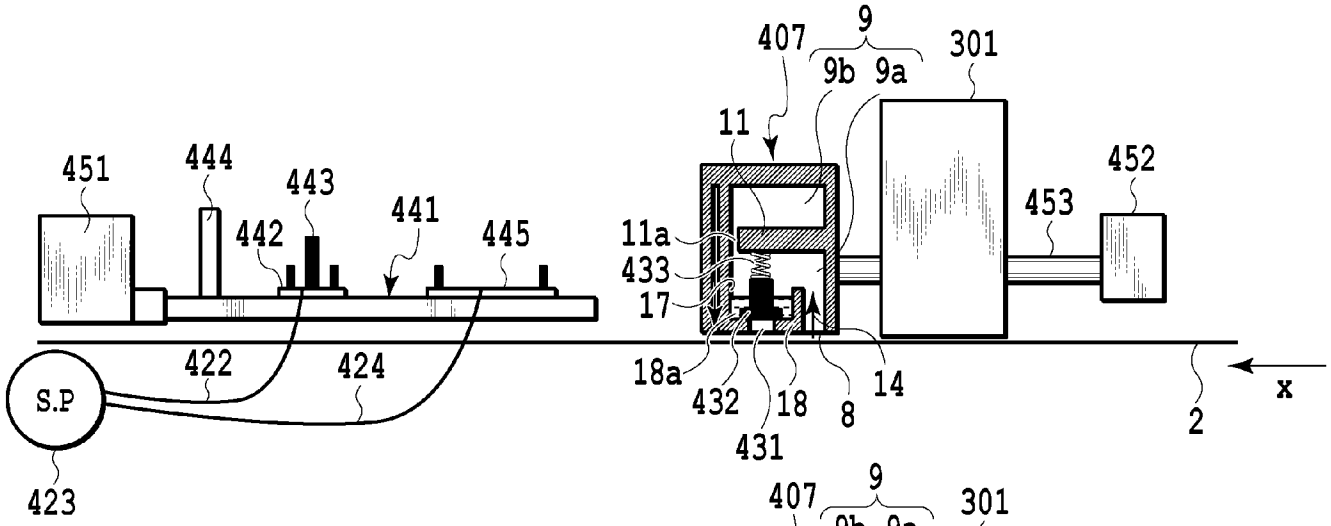
FIG. 10A and FIG. 10B are schematic views illustrating a cleaning mechanism according to the fourth embodiment and its operation.

FIG. 10A is a schematic sectional view taken along the medium conveying direction X, illustrating the vicinity of the printing unit of the ink jet printing device at the time of a normal printing operation. FIG. 10B is a schematic sectional view taken along the medium conveying direction X, illustrating the vicinity of the printing unit of the ink jet printing device at the time of a cleaning operation.

At the time of the normal printing operation, the cleaning mechanism 441 is disposed lateral to the head 301 and the mist collection mechanism 407 (in other words, at different positions in the horizontal plane) as illustrated in FIG. 10A so as not to disturb the printing operation.

(Waste-Liquid Discharging Operation)

Figure 10B:
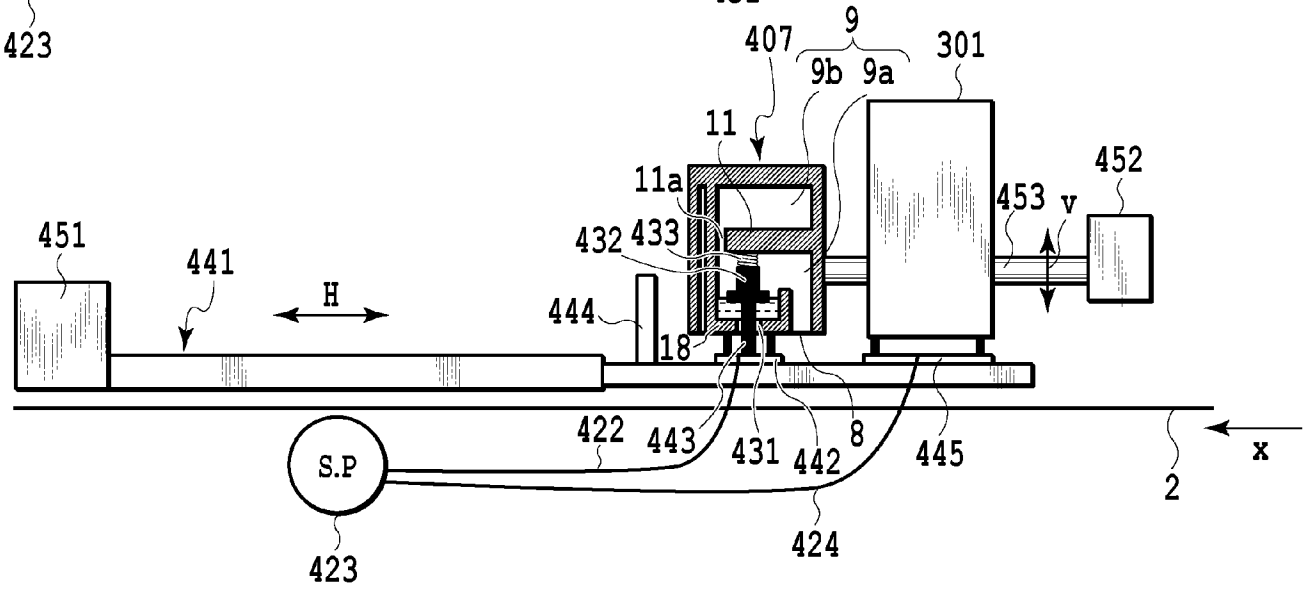

The control device, not illustrated, when determining that the predetermined maintenance period has arrived, causes the head 301 and the mist collection mechanism 407 to move from a position (first position) at the time of the normal printing operation illustrated in FIG. 10A to a position (second position) at the time of the waste-liquid discharging illustrated in FIG. 10B. Here, movement during the cleaning operation is performed by controlling the slide mechanism 451 for the cleaning mechanism 441, and the vertical mechanism 452 for the head 301 and the mist collection mechanism 407. The slide mechanism 451 slides the cleaning mechanism 441 in the horizontal direction H. Furthermore, the vertical mechanism 452 moves the head 301 and the mist collection mechanism 407 in the vertical direction V. The waste-liquid discharging operation is performed at the second position.

The waste-liquid discharging operation will be described in detail. The control device first controls the vertical mechanism 452 to lift the head 301 and the mist collection mechanism 407 from the position (first position) at the time of the normal printing operation. The lifted position is set as a retreated position (third position) higher than the position (second position) at the time of the waste-liquid discharging illustrated in FIG. 10B. The head 301 and the mist collection mechanism 407 are integrally held by the head holder 453, and are connected with the vertical mechanism 452. Hence, the same vertical movement is performed on the head 301 and the mist collection mechanism 407 by sharing one vertical mechanism 452.

The control device then controls the slide mechanism 451 to slide the cleaning mechanism 441 in the horizontal direction H, thereby moving the recovery pad 445 and the pad 442 to be positioned immediately below the head 301 and the mist collection mechanism 407, respectively.

Furthermore, the control device controls the vertical mechanism 452 to lower the head 301 and the mist collection mechanism 407 from the retreated position (third position) to the position (second position) at the time of the waste-liquid discharging illustrated in FIG. 10B to bring them into contact with the recovery pad 445 and the pad 442, respectively. At this time, the valve opening pin 443 of the pad 442 pushes up the discharging valve 432 that has closed the discharging port 431 of the mist collection mechanism 407 to open the discharging port 431, which makes it possible to discharge the waste liquid in the liquid receiver 18*a* of the mist collection mechanism 407 to the outside through the discharging port 431.

While keeping the state, the control device activates the sucking device 423 connected with the pad 442 through the discharging tube 422, to depressurize the space sandwiched by the pad 442 and the mist collection mechanism 407, thereby discharging the waste liquid stored in the mist collection mechanism 407. Since the recovery pad 445 is also connected with the sucking device 423 through the discharging tube 424, the space sandwiched by the recovery pad 445 and the head 301 is also depressurized at the same time, and suction and recovery of the head 301 are performed.

(Wiping Operation)

After discharging the waste liquid of ink mist is completed, the control device starts a wiping operation of wiping the waste liquid remaining on the bottom surface of the mist collection mechanism 407 in the vicinity of the discharging port 431. During this wiping operation, ink remaining on the surface (ink ejecting surface) of the head 301 is also wiped at the same time.

The wiping operation will be described in detail. The control device controls the vertical mechanism 452 to move the head 301 and the mist collection mechanism 407 in the vertical direction so as to position them at the position (fourth position) at the time of the wiping operation. The position (fourth position) at the time of the wiping operation is a position of height where the head 301 and the mist collection mechanism 407 are not brought into contact with other elements of the cleaning mechanism 441 such as the pad 442, the valve opening pin 443, and the recovery pad 445 but are brought into contact with the vicinity of an end portion of the wiper blade 444.

The control device then controls the slide mechanism 451 to slide the cleaning mechanism 441 in the horizontal direction H to sequentially bring the vicinity of the end portion of the wiper blade 444 into contact with the head 301 and the mist collection mechanism 407, and wipe their surfaces, whereby cleaning is performed.

The control device then controls the vertical mechanism 452 to lift the head 301 and the mist collection mechanism 407 to the retreated position (fifth position) higher than the position (fourth position) at the time of the wiping operation, thereby preventing the end portion of the wiper blade 444 from being brought into contact with them. At this time, it is possible to set the retreated position (fifth position) to the same position as the retreated position (third position) described above.

Furthermore, the control device controls the slide mechanism 451 and the vertical mechanism 452 to move the cleaning mechanism 441, the head 301, and the mist collection mechanism 407 to the position (first position) at the time of the normal printing operation illustrated in FIG. 10A.

These are descriptions of the cleaning operation according to this embodiment.

According to the fourth embodiment, with the configuration and operations described above, the waste liquid can be quickly and sufficiently discharged from the mist collection mechanism even in a case where a constraint is generated in guiding the waste liquid of ink mist to the discharging port provided on both ends of the mist collection mechanism in the longitudinal direction.

Hereinafter, a modification example of the fourth embodiment according to the present invention will be described.

In the example described above, part or all of the plural discharging ports 431 are positioned above the printing region in a range of the printing width (the width indicated by the arrow 2*b* in the drawing). However, it may be possible to employ a configuration in which one or more discharging ports 431 are provided on the outside of both ends of or the outside of one end of the printing width so as to depart from above the medium 2.

In the example described above, the recovery pad 445 for the head 301 and the cleaning mechanism 441 for the mist collection mechanism 407 are provided in a combined manner, and the wiper blade 444 that wipes the mist collection mechanism 407 is also used to wipe the head 301. However, it may be possible to employ a configuration in which an independent recovery pad 445 for the head 301 and a recovery mechanism for the head 301 having a wiper blade are separately provided, and the vertical and the slide movement thereof are performed independently from the cleaning mechanism 441 for the mist collection mechanism 407.

In the example described above, the cleaning operation for the mist collection mechanism 407 and the cleaning operation for the head 301 are performed at the same timing. However, these cleaning operations may be performed separately at their own required timings.

In the example described above, at the time of the normal printing operation, the cleaning mechanism 441 is disposed on the downstream side of the head 301 and the mist collection mechanism 407 in the medium conveying direction X. However, it may be possible to employ a configuration in which the cleaning mechanism 441 is disposed on the upstream side of the head 301 and the mist collection mechanism 407 in the medium conveying direction X, or is disposed lateral to them in the printing width direction.

In the example described above, the cleaning mechanism 441 is disposed above the medium 2 at the time of the normal printing operation. However, it may be possible to employ a configuration in which the cleaning mechanism 441 is disposed below the medium 2 at the time of the normal printing operation. Furthermore, it may be possible to dispose the cleaning mechanism 441 immediately below the head 301 and the mist collection mechanism 407 at the time of the normal printing operation.

Figure 11:
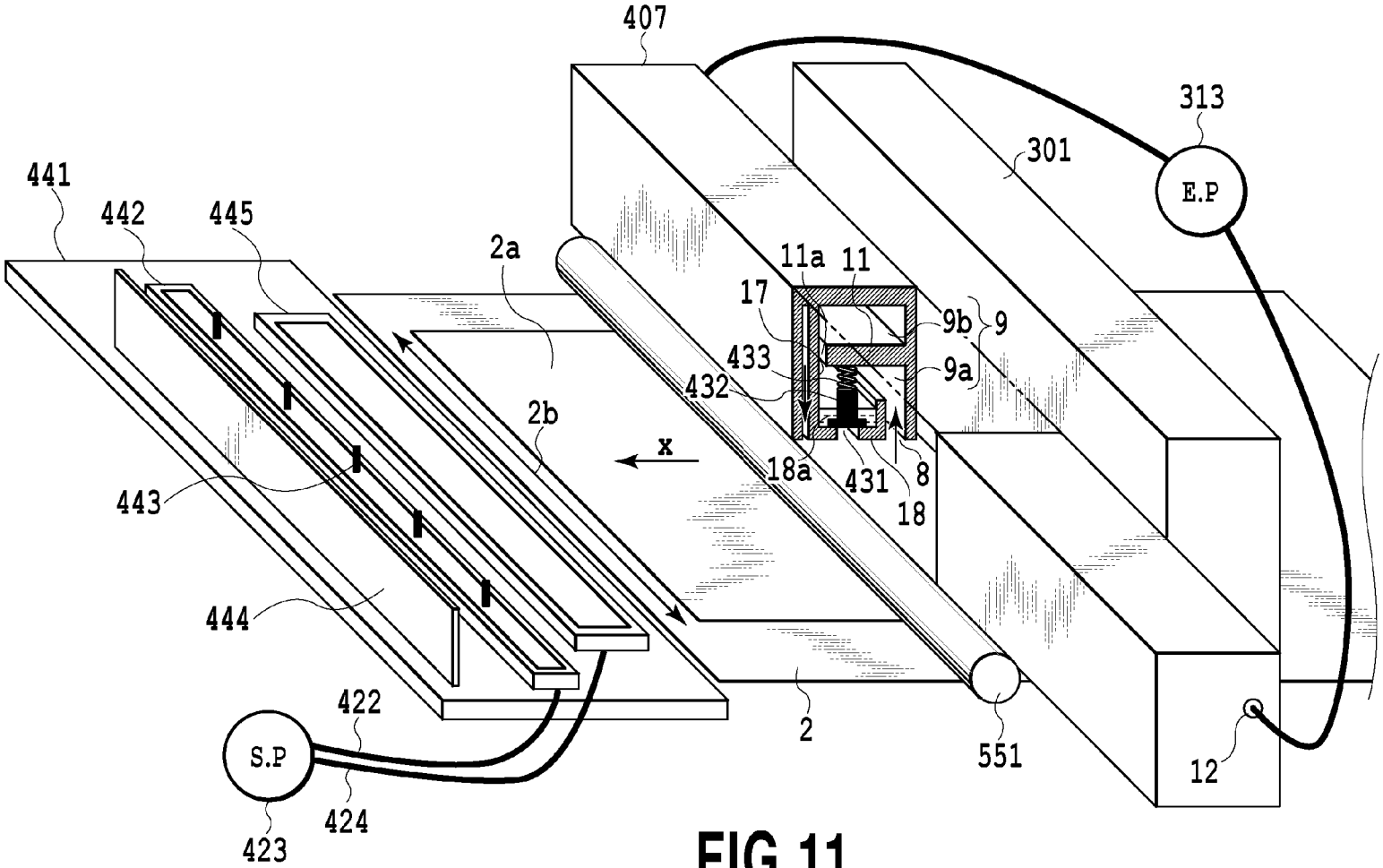
FIG. 11 is a schematic view illustrating a configuration of an ink jet printing device according to a fifth embodiment.

A fifth embodiment of the present invention will be described with reference to FIG. 11. In the drawing, the same reference signs are attached to portions having configurations similar to those of the first to fourth embodiments, and explanation thereof will not be repeated.

In a mist collection mechanism 407 according to the fifth embodiment, an ink mist flowing from the head 301 to the downstream side due to conveyance of the medium 2 is collected from the suction port 8 as in the first to fourth embodiments. The mist collection mechanism 407 includes, in the airflow path 9, the spatial region 9*b* that can function as the pressure buffer chamber, whereby it is possible to achieve a uniform flow rate of air on the opening plane of the suction port 8, as described in the first embodiment.

In the second to fourth embodiments, the mist collection mechanism is provided with the blowout port 20, and air 21 is caused to be blown out from the blowout port 20, whereby an efficiency in collecting air 14 around the head is improved. On the other hand, the fifth embodiment employs a damming effect with a pinch roller to improve an efficiency in collecting the air 14 around the head.

More specifically, in the fifth embodiment, a pinch roller 551 is disposed on the downstream side of the mist collection mechanism 407, and flow of the air 14 between the mist collection mechanism 407 and the medium 2 is dammed. With this configuration, the air 14 containing an ink mist is not allowed to leak downstream, whereby it is possible to improve an efficiency in collecting the ink mist from the suction port 8.

In this example, in order to achieve a favorable damming effect, the pinch roller 551 is configured integrally so as to extend across the maximum printing width (the width indicated by the arrow 2*b* in FIG. 11) in a design. However, in the present invention, it may be possible to employ a configuration in which the pinch roller 551 is divided into plural rollers with the minimum clearance to a degree that the damming effect can be sufficiently exhibited.

A sixth embodiment of the present invention will be described with reference to FIG. 12. In the drawing, the same reference signs are attached to portions having configurations similar to those of the first to fifth embodiments, and explanation thereof will not be repeated.

The ink jet printing device according to the first to fifth embodiments has been described on the assumption that the printing device is a full line system that performs printing using a long-length head. However, the present invention may be applied to a printing device of a serial scan system that performs printing while moving a head in a scanning direction. The sixth embodiment gives one example of an ink jet printing device of a serial scan system according to the present invention.

Figure 12:
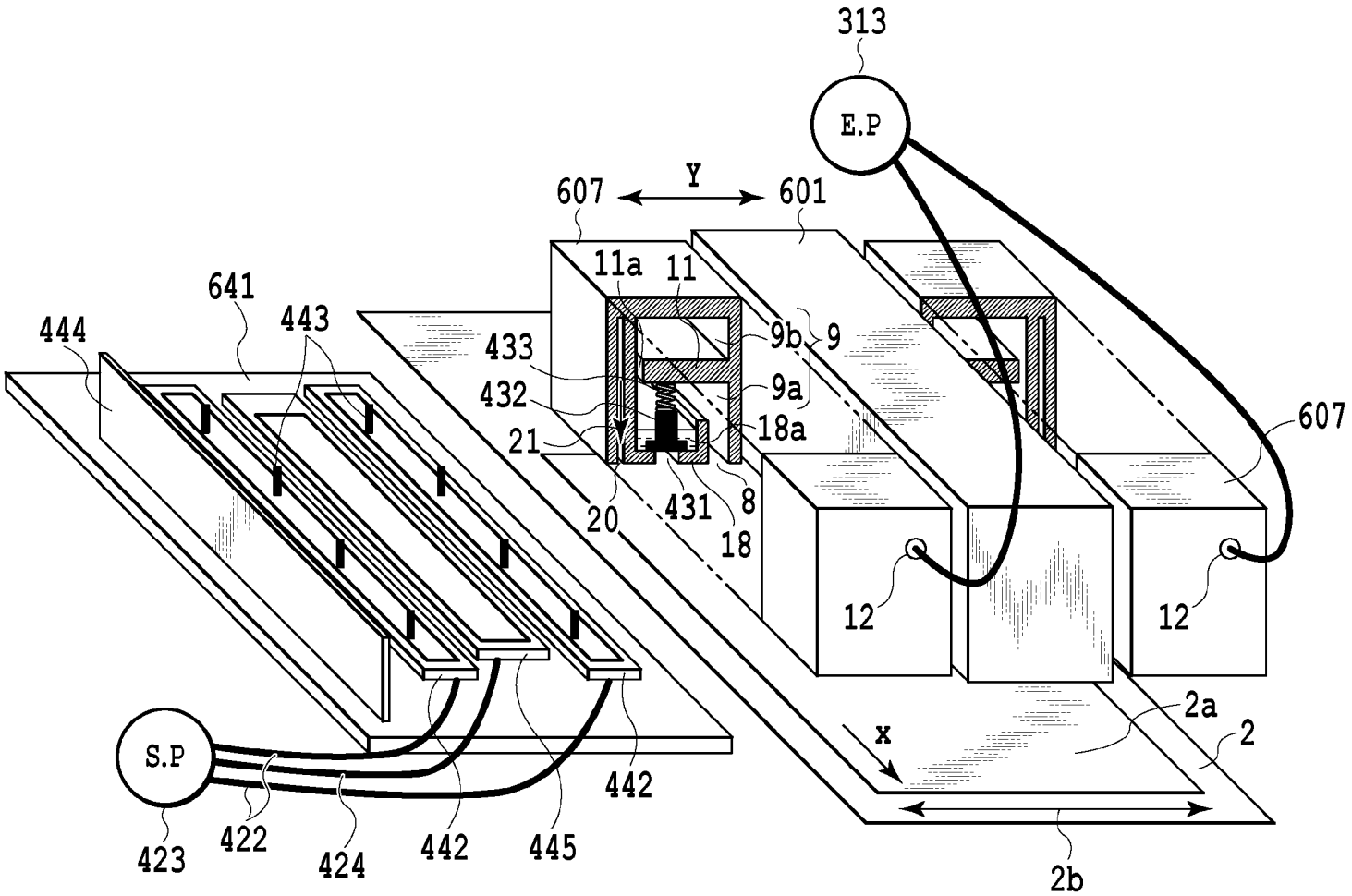
FIG. 12 is a schematic view illustrating a configuration of an ink jet printing device according to a sixth embodiment.

FIG. 12 is a perspective view schematically illustrating a configuration of the vicinity of the printing unit of the ink jet printing device according to the sixth embodiment of the present invention. In FIG. 12, a mist collection mechanism 607 is illustrated so as to be cut along the short-side direction and partially removed in the vicinity of the center in the medium conveying direction X, for the purpose of explaining the internal structure. The ink jet printing device according to the sixth embodiment includes a conveying unit, a printing unit, an ink-mist collection mechanism, and a cleaning mechanism.

(Conveying Unit)

The conveying unit (not illustrated) has a configuration similar to that in the first embodiment, and hence, explanation thereof will not be repeated. The conveying unit conveys the medium 2 in the medium conveying direction X below a head 601 at the time of printing.

(Printing Unit)

The printing unit includes one head 601, which is a so-called multi-color head in which one head ejects plural colors of ink to perform printing. The head 601 is a serial scan system, and includes plural ejection port lines in which ejection ports of nozzles of an ink jet system are arranged side by side in the longitudinal direction. In this example, each of the ejection port lines ejects a black ink, a cyan ink, or a magenta ink. However, in the present invention, the number of colors of ink and the number of heads are not limited to those described above.

The head 601 is connected with an ink tube, not illustrated, and an ink is supplied from an ink tank, not illustrated. However, in the present invention, the head 601 may be a unit configured integrally with an ink tank that stores a corresponding color of ink.

The head 601 is mounted on a carriage, not illustrated, in a manner such that the longitudinal direction of the head 601 extends along the medium conveying direction. The head 601 ejects an ink while being reciprocatingly moved in a scanning direction indicated by the left-right arrow Y, and printing is performed on the medium 2 positioned below the head 601. In FIG. 12, the arrow 2*b* indicates the maximum printing width in a design of the printing device. Furthermore, the region 2*a* indicates a region on which printing is performed.

(Mist Collection Mechanism)

The mist collection mechanism 607 is mounted on the same carriage as the head 601 so as not to relatively move with respect to the head 601, and moves as the head 601 moves.

In the sixth embodiment, the mist collection mechanism 607 collects, from the suction port 8, an ink mist on the upstream side of the head 601 in the scanning direction. In the sixth embodiment, the suction port 8 of the mist collection mechanism 607 has the short side in the printing width direction of the printing device, that is, in the scanning direction Y of the head 601, and has the long side in the medium conveying direction X.

This example performs printing in both directions while reciprocally moving the head 601. Thus, the mist collection mechanism 607 is provided on both ends of the head 601 in the scanning direction Y. Furthermore, in relation to this, the cleaning mechanism 641 has the pad 442 provided on both sides of the recovery pad 445.

The mist collection mechanism 607 according to the sixth embodiment has a configuration similar to the mist collection mechanism 407 according to the fourth embodiment described with reference to FIGS. 9A and 9B. The mist collection mechanism 607 also includes, in the airflow path 9, the spatial region 9*b* that can function as the pressure buffer chamber as described in the first embodiment, whereby it is possible to achieve a uniform flow rate of air on the opening plane of the suction port 8.

In the example described above, the printing device is a bidirectional printing system in which printing is performed during a time when the head 601 is caused to scan in both directions in the scanning direction Y. However, the present invention may be applied to a unidirectional printing system in which printing is performed only during a time when the head 601 is caused to scan in one direction.

In the case of the unidirectional printing system, it may be possible to dispose the mist collection mechanism 407 only on the upstream side in the scanning direction when printing is performed with the head 301. In relation to this, the cleaning mechanism 641 may be provided with the pad 442 on one side of the recovery pad 445.

As described above, in the printing device according to the present invention, the mist collection mechanism includes, in the airflow path 9, the spatial region 9*b* that can function as the pressure buffer chamber, whereby it is possible to achieve a uniform flow rate of air on the opening plane of the suction port 8. Thus, regardless of arrangement of the suction unit, it is possible to perform suction substantially at a uniform flow rate throughout the entire opening plane of the duct, whereby it is possible to reliably suppress contamination of the head and its vicinity with the ink mist.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-157465 filed on Aug. 1, 2014 which is hereby incorporated by reference herein in its entirety.

What is claimed is:

1. A printing device, comprising:

a head that ejects ink on a medium to perform printing; and a mist collection unit, provided near the head, including:

a suction port facing the medium and sucking in air with ink mist;

a housing having an inside space that includes a first spatial region located on a side of the suction port, a second spatial region located adjacent to the first spatial region and an opening provided between the first spatial region and the second spatial region, wherein the air sucked from the suction port flows through the first spatial region, the opening, and the second spatial region, and then is exhausted from the second spatial region; and a liquid receiver provided in the housing to receive and hold liquid of the ink mist which liquefies on an inner wall in the housing and drops due to gravitation.

2. The printing device according to claim 1, wherein the head is of a line-type and is provided in plurality along a direction in which the medium moves, and the mist collection unit is provided between adjacent heads.

3. The printing device according to claim 1, wherein the opening is provided at a boundary between the first spatial region and the second spatial region and is smaller than the suction port.

4. The printing device according to claim 1, wherein the head is of a line-type, and the housing, the suction port and the opening are formed along a longitudinal direction of the head.

5. The printing device according to claim 4, wherein the opening is provided in plurality and is arranged in a distributed manner along the longitudinal direction of the head.

6. The printing device according to claim 5, wherein the plurality of openings is arranged at regular intervals in the longitudinal direction of the head.

7. The printing device according to claim 1, wherein the opening is disposed above the suction port with respect to a gravitational direction, and is offset from the suction port in a short-side direction of the suction port.

8. The printing device according to claim 1, wherein the first spatial region is formed into a streamline shape from the suction port to the opening.

9. The printing device according to claim 1, wherein the mist collection unit comprises a blowout port, provided adjacent to the suction port, to blow out air to the medium.

10. The printing device according to claim 1, wherein the liquid receiver is formed with a barb which extends from at least part of the peripheral edge of the suction port or from a vicinity of the peripheral edge of the suction port in the first spatial region.

11. The printing device according to claim 10, wherein the opening is provided above the barb with respect to a gravitational direction.

12. The printing device according to claim 10, further comprising a mechanism to discharge the liquid from the liquid receiver.

13. The printing device according to claim 12, wherein the mist collection unit has a discharging port through which the liquid is discharged from the liquid receiver, and the liquid receiver has a bottom surface that is tilted so that a height of the bottom surface in the gravitational direction gradually decreases toward the discharge port.

14. The printing device according to claim 1, further comprising a cleaning mechanism to perform cleaning of the mist collection unit.

15. The printing device according to claim 14, wherein the cleaning mechanism includes a wipe mechanism for wiping the mist collection mechanism and the head.

16. A printing device, comprising:

a head that ejects ink on a medium to perform printing; and a mist collection unit, provided near the head, including:

a suction port facing the medium and sucking in air with ink mist; and a housing having an inside space that includes a first spatial region located on a side of the suction port, a second spatial region located adjacent to the first spatial region, and a communicating port having openings provided between the first spatial region and the second spatial region, the openings being smaller than the suction port, wherein the air sucked from the suction port flows through the first spatial region, the openings, and the second spatial region, and then is exhausted from the second spatial region, wherein each of the suction port and the communicating port is formed along a longitudinal direction of the head, and the openings are arranged in a distributed manner along the longitudinal direction of the head.

17. The printing device according to claim 16, wherein the mist collection unit comprises a blowout port, provided adjacent to the suction port, to blow out air to the medium.

18. The printing device according to claim 16, wherein the head is of a line-type and is provided in plurality along a direction in which the medium moves, and the mist collection unit is provided between adjacent heads.

* * * * *